United States Patent [19]

Reynolds et al.

[11] 4,172,410

[45] Oct. 30, 1979

[54] HELICAL LOCK FOR AUTOMATIC GUN

[75] Inventors: John A. Reynolds, Illinois City; Gerald R. Anderson, Coal Valley, both of Ill.

[73] Assignee: The United States of America as represented by Secretary of the Army, Washington, D.C.

[21] Appl. No.: 871,271

[22] Filed: Jan. 23, 1978

[51] Int. Cl.[2] ..... F41D 11/06

[52] U.S. Cl. ..... 89/188; 89/11

[58] Field of Search ..... 89/11, 188

[56] References Cited

U.S. PATENT DOCUMENTS

| | | | |
|---|---|---|---|
| 3,766,821 | 10/1973 | Cozzy et al. | 89/188 |
| 4,065,998 | 1/1978 | Rocha | 89/11 |

*Primary Examiner*—Stephen C. Bentley

*Attorney, Agent, or Firm*—Nathan Edelberg; Robert O. Richardson

[57] ABSTRACT

A helical lock for an automatic gun operated by a rotating drum wherein a locking ring and mating end of the chamber have helical surfaces, whereby upon rotating the locking ring to locked position, the chamber is snugly urged into the barrel in its battery position and thus prevent gas leakage therebetween.

3 Claims, 4 Drawing Figures

26
24
12
10
20
1
2
2
28
14
30
32
34
33
36
48
18
16
22

HELICAL LOCK FOR AUTOMATIC GUN

GOVERNMENT RIGHTS

The invention described herein may be manufactured and/or used by or for the Government for governmental purposes without the payment of any royalty thereon.

RELATED INVENTIONS

The present invention represents an improvement over co-pending application by Taylor and Anderson, Ser. No. 821,016, filed Aug. 1, 1977 for Locking and Firing Mechanism for Rotating Cam Actuated Weapons now U.S. Pat. No. 4,141,276, issuing Feb. 27, 1979.

BACKGROUND OF THE INVENTION

The present invention relates to a helical locking mechanism for weapons with sliding chambers. In weapons of this type, the firing chamber is separate from the gun tube or barrel, and slides longitudinally within the weapon frame or receiver. As a round of ammunition is fed into the receiver, the chamber moves forward, encapsulating the round. The chamber must be locked in this position before the weapon is fired. This is to prevent recoil forces from damaging other weapon components and to prevent the loss of propellent gases. Obviously if propellent gases were allowed to escape from the chamber during firing, the velocity of the fired projectile would be greatly reduced. This is especially true when using telescoped or caseless ammunition. In telescoped rounds the projectile is surrounded by propellent and encased in a metal casing. Caseless ammunition is of similar construction, but without the metal casing. This type of round is entirely dependent on chamber sealing to contain the propellent gases, since there is no cartridge casing. These rounds are generally the type of ammunition associated with sliding chamber weapons. Therefore chamber sealing is critical.

Normally, conventional locking mechanisms do not provide means to tightly seal the chamber against the breech end of the gun tube, but simply retain the chamber once it is positioned in battery position. Great precision is then required in manufacturing the chamber and related components to achieve the proper fit and sealing required. This increases the cost of weapon components without completely eliminating the problem of gas leakage from the chamber. Even in the most carefully machined components certain clearances are necessary for proper operation. For example, lug type locking mechanisms utilize one or more lugs which are engageable with recesses in the receiver. The recess, to receive the locking lug, must be slightly larger than the lug itself to allow smooth operation of the mechanism during locking and unlocking. This built-in clearance allows some minute chamber movement while in the locked position. This is a compromise situation which is generally accepted in current gun designs. Also minute changes in chamber dimensions occur after a few rounds are fired. This is due to thermal expansion; i.e., the chamber expands due to the heat generated from firing previous rounds. This further aggravates the problem of chamber sealing.

SUMMARY OF THE PRESENT INVENTION

The present invention eliminates the need for a built-in clearance which is required in conventional locking mechanisms. This is accomplished by utilizing a helical surface on the locking ring and the mating surface on the chamber. The locking ring is a cog wheel which is rotatably mounted on the rear end of the chamber. As the chamber reciprocates the teeth on the locking ring are aligned with and slide in slots in the receiver. When the chamber reaches the in-battery position, the locking ring is rotated several degrees in a circumferential groove forwardly of the slots. This causes the teeth to misalign with the slots in the receiver, thereby locking the chamber in the in-battery position. Also as the locking ring completes its rotation the helical surface on the ring engages the mating surface on the chamber while the teeth engage their respective locking surfaces. By this action the chamber is forced tightly against the breech, in a manner similar to tightening a lid on a jar.

This mechanism allows a relaxation of production tolerances which, in turn, reduces manufacturing costs. Also the built-in clearances of conventional locking mechanisms has been eliminated. It also precludes the possibility of chamber leakage due to thermal expansion. This assures proper round obturation and maximum chamber pressure. Maximum performance from the ammunition can then be expected.

DETAILED DESCRIPTION OF ILLUSTRATIVE EMBODIMENTS

Figure 1:
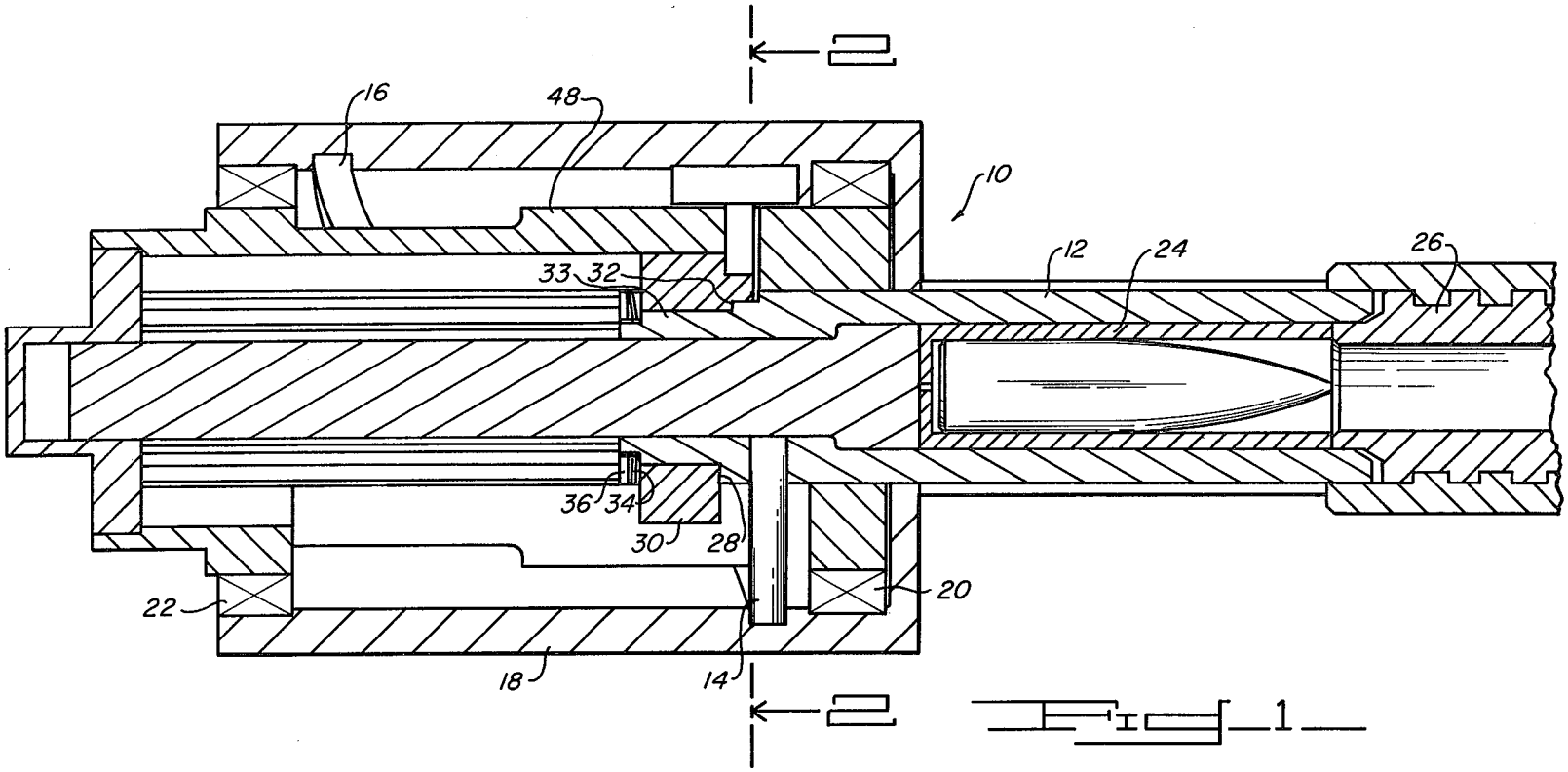
FIG. 1 is a longitudinal sectional view of a sliding chamber weapon.

Reference is now made to FIG. 1 wherein there is shown a longitudinal cross sectional view of sliding chamber weapon 10. The weapon is designated as such since the chamber 12 reciprocates between the in-battery position, shown in FIG. 1, and a recoil position, which would be to the left of its position in FIG. 1. This is to allow the ejection of fired cartridge cases from the weapon and feeding of fresh rounds into the chamber. The chamber 12 is actuated between these positions by a stud 14 on the chamber which rides in a helical cam path 16. The cam path 16 is engraved in the inside circumference of drum 18 which is rotated by an electric motor (not shown) and supported at both ends by bearings 20, 22. It can be seen that the action of the stud 14 in the cam path 16 in the rotating drum 18 will cause the desired reciprocal motion of the chamber 12.

In operation a round of ammunition 24 is introduced into the weapon while the chamber 12 is in its rearward or recoil position. As drum 18 rotates, the chamber 12 then moves forward to the position shown in FIG. 1 by means of the mechanism previously described. The chamber 12 encapsulates the round 24 to contain combustion gases when the round is detonated. It is desirable to effectively seal the chamber to prevent the escape of combustion gases, to assure maximum performance from the round. For this purpose the weapon incorporates a locking mechanism which not only retains the chamber 12, but tightly forces it against the mating surface on the barrel 26.

At the inner end of chamber 12 is a helical surface 28 against which bears a locking ring 30 which is rotatably mounted on a chamber extension 33. A spring washer 34 separates the lock ring 30 from a retainer 36 which is threaded onto chamber extension 33 to retain the lock ring on the extension and permit its rotation. This arrangement allows longitudinal as well as rotational movement of the lock ring 30 relative to the chamber 12, thereby pushing chamber 12 snugly into barrel 26 when in battery position.

Figure 2:
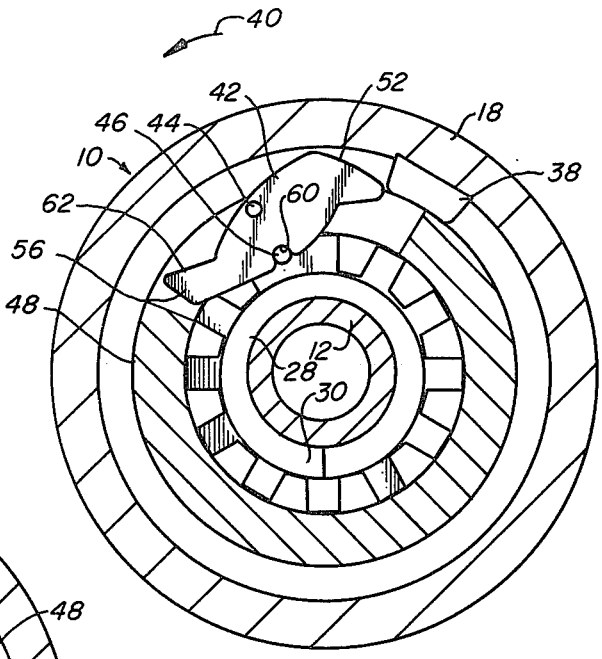
FIG. 2 is a sectional view taken along line 2—2 of FIG. 1 and showing the locking mechanism in unlocked position.

FIG. 2 shows the locking mechanism in the unlocked position. In this position the teeth 50 on the locking ring 30 are aligned with slots 52 in the receiver 48 (see FIG. 4). Thus the chamber 12 is free to move longitudinally within the receiver 48 between its recoil and battery positions. The drum 18 carries a lump cam 38 on its inner circumference. This lump cam 38 activates the locking mechanism when the drum is rotated. The drum 18 rotates in the direction of arrow 40. As the drum continues rotation from the position shown in FIG. 2 the lump cam 38 contacts the actuator 42 which is pivotally mounted by pin 44 onto receiver 48. This causes the actuator 42 to pivot to the position shown in FIG. 3. The pivotal movement of the actuator 42 causes the lock ring 30 to rotate several degrees due to engagement of the actuator 42 with pin 46 on the lock ring 30, as shown.

Figure 3:
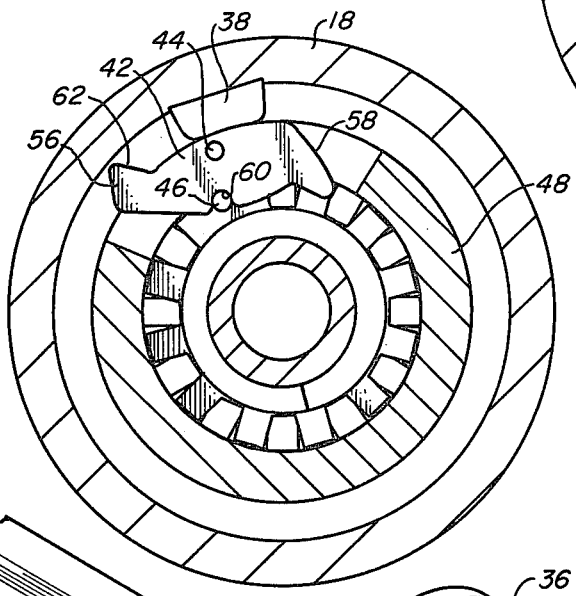
FIG. 3 is a similar view but with the locking mechanism shown in locked position.

With the locking assembly components positioned as in FIG. 3 the chamber 12 is locked in battery position. This is because the teeth 50 on the lock ring 30 are misaligned with the slots 52 in the receiver and bear against the end surfaces 53 of splines 54. Since initial rotation of the lock ring 30 causes misalignment of the teeth 50 with slots 52, further rotation of the lock ring forces it (the ring) rearward until the teeth 50 contact the front surfaces 53 of splines 54 (see FIG. 4). The final rotation of the lock ring must then force the chamber 12 forward since the lock ring cannot be further displaced and the helical surface 32 on chamber 12 bears against the helical surface 28 on lock ring 30.

After firing has occurred, the drum 18 continues rotation in a counterclockwise direction to unlock the locking mechanism. The mechanism is unlocked as the lump cam 38 contacts end 56 of the actuator 42, in its path or rotation, pivoting it back to its original position as shown in FIG. 2. This rotation of drum 18, because of pin 14 riding in groove 16, moves chamber 12 rearwardly from battery position to recoil position, whereupon the spent cartridge casing is ejected and a fresh round chambered.

Figure 4:
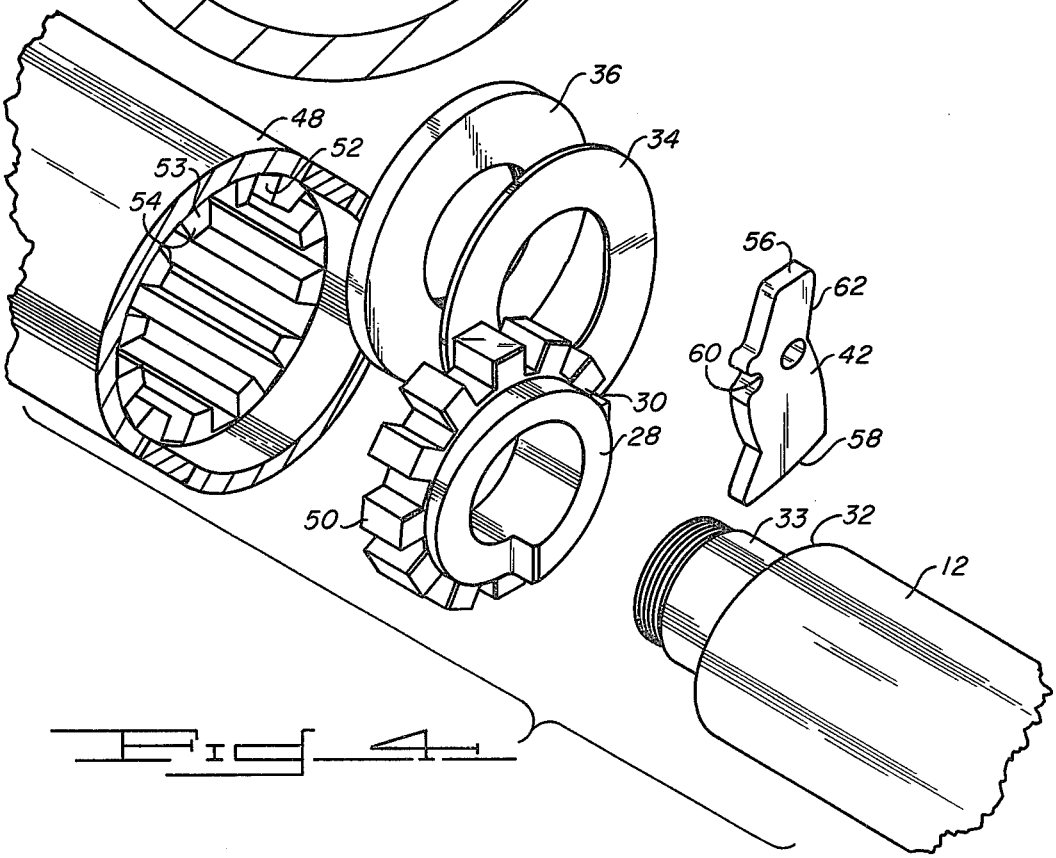
FIG. 4 is an exploded view taken in perspective to show the relationship of the various parts.

FIG. 4 is an exploded view taken in perspective to show the relationship of the various parts. Here is shown receiver 48 with splines 54 defining grooves through which the teeth 50 on locking ring 30 pass as chamber 12 moves to the right to battery position. This ring 30 is rotatably positioned over chamber extension 33 and held by retainer 36 threaded onto the extension, after spring washer 34 has been placed over the extension behind the locking ring. The spring washer 34 flexes to permit longitudinal movement of chamber 12 snugly into the barrel, shown in FIG. 1, when the locking ring 30 bears against ends 53 of splines 54 on receiver 48 and has been rotated by actuator 42.

Actuator 42 pivots on pin 44 on receiver 48, as shown in FIGS. 2 and 3. This actuator has a ramp edge 58 against which lump cam 38 on drum 18 bears to pivot this end inwardly as drum 18 rotates. Actuator 42 also has a notch 60 which engages pin 46, as shown in FIGS. 2 and 3, on locking ring 30 to cause its rotation to lock it in battery position prior to firing of the weapon. End 56 has a top ramp edge 62 against which lump cam 38 on drum 18 bears after firing and as drum 18 continues to rotate. This causes locking ring 30 to rotate back so that teeth 50 become aligned with grooves 52 and the chamber 12 becomes unlocked and will recoil back into the receiver to its recoil position.

The invention in its broader aspects is not limited to the specific combinations, improvements and instrumentalities described but departures may be made therefrom within the scope of the accompanying claims without departing from the principles of the invention and without sacrificing its chief advantages.

What is claimed is:

1. A helical lock for an automatic gun of the type having a rotating drum operable to move the gun chamber forwardly into the gun barrel in its battery position and rearwardly to its recoil position, said gun having a receiver with longitudinally extending splines mating with teeth on a locking ring on said chamber, said locking ring being moveable along said splines as said chamber moves between battery and recoil positions, said locking ring being rotatable when said chamber is in battery position to bear against the ends of said splines to maintain said chamber in battery position, means on said drum, receiver and locking ring for rotating said ring at predetermined intervals into and out of engagement with said splines for locking and unlocking said chamber in battery position, said locking ring and said chamber having mating helical surfaces thereon whereby rotation of said locking ring imparts longitudinal movement to said chamber.

2. A helical lock as in claim 1 wherein said means on said drum is a lump cam, said means on said receiver is a pivotal actuator engageable with and pivoted by said lump cam, and said means on said locking ring is a pin engageable with said actuator to rotate said locking ring as said lump cam engages and pivots said actuator.

3. A helical lock as in claim 1 wherein said locking ring moves said chamber forwardly upon rotation of said locking ring to locked position and wherein said locking ring moves said chamber rearwardly upon rotation of said locking ring to unlocked position.

* * * * *